United States Patent [19]

Knapp, Jr.

[11] 4,387,358

[45] Jun. 7, 1983

[54] SIDE MOUNTED BLOWN FUSE INDICATOR

[75] Inventor: Edward J. Knapp, Jr., Salisbury, Mass.

[73] Assignee: Gould Inc., Electric Fuse Div., Newburyport, Mass.

[21] Appl. No.: 380,172

[22] Filed: May 20, 1982

[51] Int. Cl.[3] ..... H01H 85/30

[52] U.S. Cl. ..... 337/244; 337/367

[58] Field of Search ..... 337/206, 241, 244, 265, 337/267

[56] References Cited

U.S. PATENT DOCUMENTS

| | | | |
|---|---|---|---|
| 3,535,668 | 10/1970 | Cinquin | 337/244 |
| 3,601,739 | 8/1971 | Blewitt | 337/244 |
| 4,023,133 | 5/1977 | Knapp | 337/244 |

FOREIGN PATENT DOCUMENTS

| | | | |
|---|---|---|---|
| 1538458 | 9/1969 | Fed. Rep. of Germany | 337/244 |

*Primary Examiner*—George Harris

*Attorney, Agent, or Firm*—Frederick A. Goettel, Jr.

[57] ABSTRACT

An electric fuse is provided with a blown fuse indicator mounted on a lateral wall of the fuse. One of the end terminals of the fuse is provided with a first opening therein in a surface which faces the interior of the fuse casing. The same end terminal is provided with a second opening therein which is in a peripheral surface of the terminal and which lies in a plane which is substantially parallel to the longitudinal axis of the fuse casing. The end terminal is further provided with an internal passageway therein which communicates the first and second openings. The fuse casing is provided with an opening therein which is in axial alignment with the second opening in the end terminal.

A spring loaded blown fuse indicator is mounted through the opening in the fuse casing and is fixedly and conductively engaged with at least a portion of the end terminal passageway. An indicator restraining wire has one end attached to the spring loaded indicator and extends along a path comprising at least a portion of the passageway to the interior of the fuse and from there along the full length of the fuse to the other end terminal. The restraining wire is stretched taut along its described path and is conductively attached to the other end terminal.

17 Claims, 6 Drawing Figures

SIDE MOUNTED BLOWN FUSE INDICATOR

BACKGROUND OF THE INVENTION

1. Field of the Invention

The present invention relates to means for indicating the blown or unblown condition of an electric fuse. More specifically it relates to a manner of easily mounting such an indicator on a lateral wall of a fuse.

2. Description of the Prior Art

Electric fuses are generally provided with blown fuse indicators in the form of a spring-biased indicating pin. Such pins are normally held in position by a restraining wire, and are allowed to move to a blown fuse indicating position in response to blowing of the fuse and subsequent melting of the restraining wire. Generally blown fuse indicating pins are arranged at one of the end surfaces of the fuse. Since the space available at this location is relatively limited, the pins are generally of small size. This fact combined with the fact that the end surfaces of fuses are generally much less exposed to view than the lateral surfaces thereof, imposes serious limitations on the usefulness of blown fuse indicators of the aforementioned conventional type.

In an effort to achieve a more conspicuous indication of whether or not a fuse has blown, blown fuse indicators have been arranged at the lateral surfaces of fuses, or their casings, respectively. This arrangement greatly facilitates the supervision and maintenance of fuse-protected electric distribution systems, but requires the provision of a perforation or hole in the lateral wall of the casing of such fuses, which impairs the mechanical integrity of the casing.

U.S. Pat. No. 4,023,133, BLOWN FUSE INDICATOR to E. J. Knapp, Jr. assigned to the same assignee as the present invention discloses an arrangement which provides a highly visible blown fuse indicating means on the lateral surface of a fuse casing, without any impairment of the mechanical integrity of the casing.

The above described indicator makes use of a conventional end mounted indicator and provides a side mounted assembly which comprises a plurality of additional parts to transfer the action of the end mounted indicator to a second indicator positioned at right angles with respect to the end mounted indicator.

It is a primary object of this invention to provide a side mounted blown fuse indicator which maintains the structural integrity of the fuse casing while requiring a minimum number of parts.

It is another object of this invention to provide a side mounted blown fuse indicator which has no components extending beyond the ends of the fuse.

SUMMARY OF THE INVENTION

The present invention relates to an electric fuse having a blown fuse indicator mounted on a lateral wall of the fuse. The fuse is of the type comprising a casing made from an insulating material and having open ends which are closed by a pair of end terminals. A fusible element contained within the casing conductively interconnects the end terminals. One of the end terminals is provided with a first opening therein in a surface which faces the interior of the fuse casing. The same end terminal is provided with a second opening therein which is in a peripheral surface of the terminal and which lies in a plane which is substantially parallel to the longitudinal axis of the fuse casing. The end terminal is further provided with an internal passageway therein which communicates the first and second openings. The fuse casing is provided with an opening therein which is in axial alignment with the second opening in the end terminal.

A spring loaded blown fuse indicator is mounted through the opening in the fuse casing and is fixedly and conductively engaged with at least a portion of the end terminal passageway. An indicator restraining wire has one end attached to the spring loaded indicator and extends along a path comprising at least a portion of the passageway to the interior of the fuse and from there along the full length of the fuse to the other end terminal. The restraining wire is stretched taut along its described path and is conductively attached to the other end terminal.

BRIEF DESCRIPTION OF THE DRAWING

The novel features that are considered characteristic of the invention are set forth with particularity in the appended claims. The invention itself, however, both as to its organization and its method of operation, together with additional objects and advantages thereof, will best be understood from the following description of the preferred embodiment when read in connection with the accompanying drawings wherein like numbers have been employed in the different figures to denote the same parts and wherein:

DESCRIPTION OF THE PREFERRED EMBODIMENTS

Figure 1:
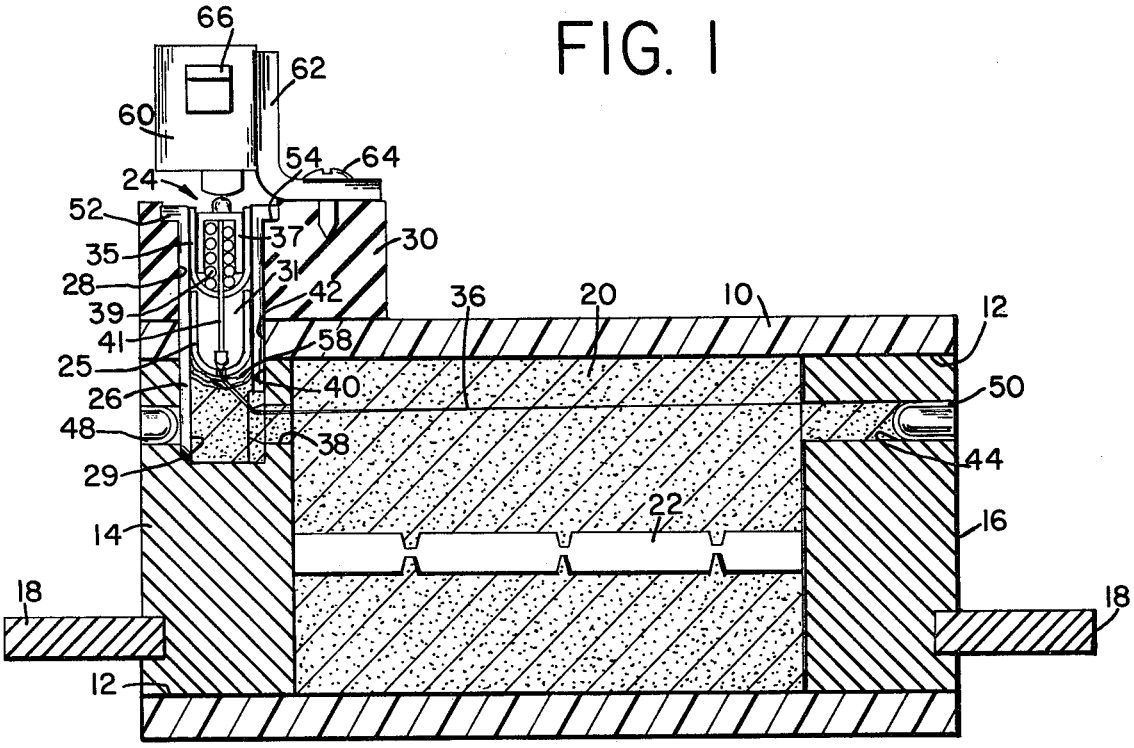
FIG. 1 is a longitudinal sectional view of an electric fuse having a blown fuse indicator according to one embodiment of this invention.

With reference to the various drawing figures reference numeral 10 refers to a tubular casing of an electric fuse. The casing is fabricated from a suitable electrically insulating material, and has open ends 12. The open ends 12 of the casing are closed by a pair of terminal plugs, a first plug 14 positioned in the left hand end of the casing and a second plug 16 in the right hand end. Each of the terminal plugs 14, 16 is provided with a blade contact 18 extending axially outwardly therefrom in a conventional manner. The end plugs 14, 16 are physically attached to the casing 10 by conventional fastener means, not shown in the drawings, such as pins passing through the casing and into openings provided in the plugs.

The casing 10 is filled with a granular arc-quenching filler material 20 which surrounds a fusible element 22 which is conductively attached to and extends between the two terminal plugs 14, 16. The fusible element 22 may preferably be formed from silver or copper or a combination thereof.

In the embodiment shown in FIGS. 1 through 4 an indicating or strike pin mechanism, of a well known configuration, generally shown as reference numeral 24 is first installed within an indicator mounting sleeve 26. The indicator comprises a first cap 25 having a U-shaped cross-section and a small hole 27 in the lower end thereof. This cap is frictionally retained in the inner bore 29 of the mounting sleeve 26 to define an upper chamber 31 and lower chamber 33 in the sleeve. As will be seen this cap 25 serves to exclude arc-quenching filler from the upper chamber 31 when installed in a fuse. A second cap 35 is frictionally retained within the upper chamber 31 of the sleeve 26 so as to preclude relative motion with respect to the sleeve. A helical spring 39 is received between the second cap 35 and a third cap 37 which is received within the second cap in a manner to allow relative motion therebetween. The cap 37 is biassed in an upward direction by the spring 39. Pin 41 is affixed to the cap 37 and passes through an opening in the stationary cap 35 where its lower end forms a perforated tab 43 to which one or more steel restraining wires 36 are attached. The wires 36 are threaded through the hole 27 in the first cap 25 and from there through the lower chamber 33 and out the end of the sleeve 26.

Figure 2:
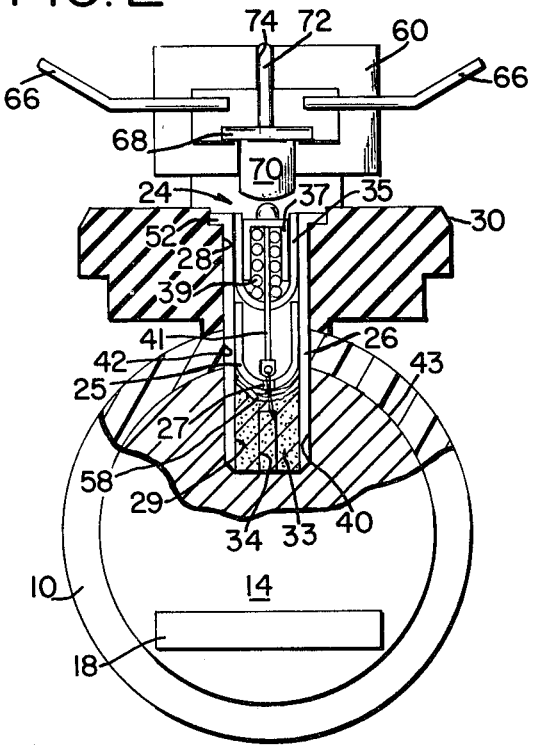
FIG. 2 is a vertical section of the structure of FIG. 1.

In the illustrated embodiment the indicator carrying mounting sleeve 26 is then press fit into a mating opening 28 provided in a block of insulating material 30. As best seen in FIGS. 1 and 2 the sleeve 26 is provided with an enlarged diameter flange 52 which is adapted to be received in a mating recess 54 in the insulating block 30 to limit penetration of the sleeve therein.

Figure 3:
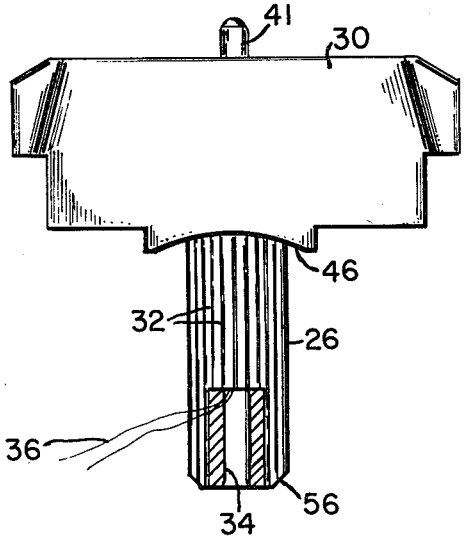
FIG. 3 is an end view of the indicator assembly of FIG. 1 shown removed from the fuse.

The structure thus described is shown in FIG. 3 wherein it will be seen that the mounting sleeve 26 is provided with a plurality of longitudinally extending grooves 32 preferably extending along its entire length. It will also be seen that the sleeve is provided with a slot 34 at its lower end through which the steel wires 36 of the indicator mechanism 24 are led. The end 56 of the sleeve is chamfered to facilitate assembly to the fuse as will subsequently be appreciated.

As best seen in FIG. 1 the first terminal plug 14 is provided with a first bore 38 extending completely therethrough in a direction parallel to the longitudinal axis of the casing 10. A second bore 40 is provided in the terminal plug 14 extending from the outer peripheral surface 43 of the plug in a direction perpendicular to and intersecting with the first bore 38. The fuse casing 10 is provided with a hole 42 through its wall in axial alignment with second bore 40. It should be appreciated that the diameter of the hole 42 in the casing wall and the bore 40 are considerably smaller than the overall axial thickness of the terminal plug 14 and accordingly they do not detract from the structural integrity of the casing 10 or the end terminal 14.

With particular reference to FIGS. 1 and 2 it will be appreciated that installation of the above described indicator/sleeve assembly 24, 26 to the fuse is quite simply accomplished. The first step is to thread the steel restraining wires 36 along a path defined in turn by the hole 42 in the casing, through the second bore 40, through a sharp turn into and through the first bore 38 and from there along the length of the fuse and through an opening 44 provided in the other end terminal 16 to the exterior of the fuse. The end 56 of the mounting sleeve 26 is then positioned in axial alignment with openings 42 and 40 and sufficient force is imparted upon the outward end 52 of the sleeve to drive it into its final operative position as shown in FIG. 1. It is noted that the downwardly facing surface 46 of the insulating block 30 is contoured to mate with the outer surface of the casing 10 when in this position. The length of the mounting sleeve is such, and its outer diameter is sized such, that when in its operative position a good portion of the length of the mounting sleeve 26 is in tight contact with the second bore 40 and the end terminal 14 to thereby establish positive attachment of the indicator assembly to the fuse as well as assuring good electrical contact therebetween.

In order to assure that the granular filler material 20 is kept from passing through the opening 27 in the cap 25 through which the restraining wire 36 passes a quantity of a suitable pasty substance 58 is applied in the lower chamber 33 of the sleeve 26. The pasty substance must preclude entry of the filler into the upper chamber 31 but must allow free longitudinal movement of the restraining wire. Silicone grease has been found to be particularly suitable for this purpose because of the relatively high temperature which may be encountered in electrical equipment of the kind under consideration.

A plug 48 is provided in the outward end of the first bore 38 to effectively seal that end of the fuse. It will be appreciated that, by leaving the bore 38 open until the indicator and restraining wire are installed facilitates threading the restraining wire 26 through its described path.

At this point in the assembly of a fuse the filler material 20 is added through the opening 44 in the terminal 16. Following filling the restraining pin is set or cocked by pulling on the wire passing through the opening 44 and the wire is anchored by installation of a plug 50 in the opening 44, again as best seen in FIG. 1.

As thus assembled the fuse forms a first current path 18, 14, 22, 16, 18 of relatively low resistance and a shunt path 18, 14, 26, 35, 37, 41, 36, 16, 18 of relatively high resistance. Melting and vaporization of the fusible element 22 interrupts the first current path and thereafter the second current path begins to carry current. As an immediate result, the restraining wire 36 melts and cap 37 and pin 41 are propelled upwardly by the spring 39. The indicator 24 is shown in such "blown fuse" condition in FIG. 4. The cap 37 is generally painted red to facilitate visual detection of the blown fuse condition.

In the present embodiment a second insulating block 60 which contains a switch mechanism is attached to the indicator insulating block 30. Such attachment may be made by any of several suitable means and as shown includes an L-shaped bracket 62 suitably fastened to a sidewall of the switch block and to the upper surface of the indicator block, as by a self tapping screw 64 or the like.

In its illustrated form the switch includes a pair of fixed contacts 66 mounted in the block 60 and a movable bridge contact 68. The latter is supported by an insulating pin 70 whose lower end rests upon the head of the indicating pin 41. The contacts are intended to control a circuit for remote indication of whether or not any particular fuse has blown. Upon blowing of the fuse the upward movement of the pin 41 and cap 37 causes engagement of the fixed contact 66 by the contact 68 closing a circuit whose function is remote indication of the fact that the fuse has blown.

Figure 4:
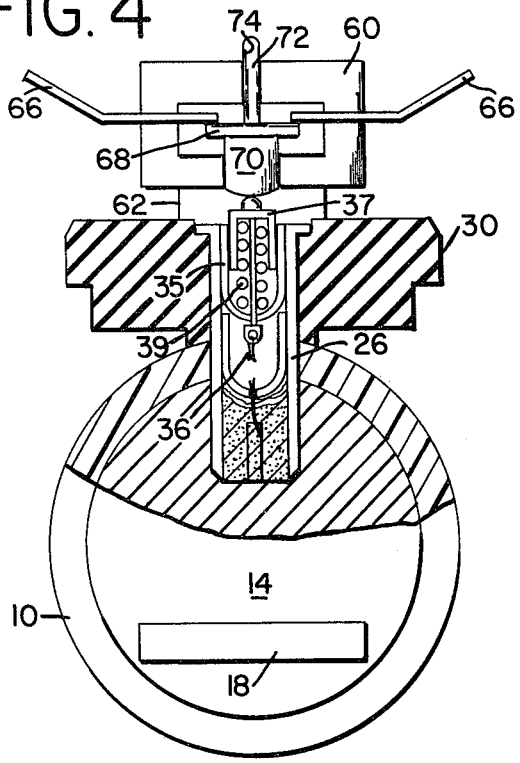
FIG. 4 is a view similar to FIG. 2 showing the indicator condition upon blowing of the fuse.

The insulating pin 70 is provided with an upwardly extending post 72 which passes through an opening 74 in the upper wall of the switch box 60. This part may be painted red and serves as a visual indication of the fuse condition as it extends beyond the outer surface of the switch block, as shown in FIG. 4, when the fuse has blown.

Figure 5:
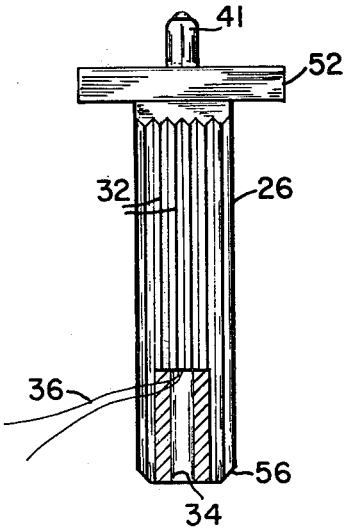
FIG. 5 is a view of an indicator according to another embodiment of the invention.
Figure 6:
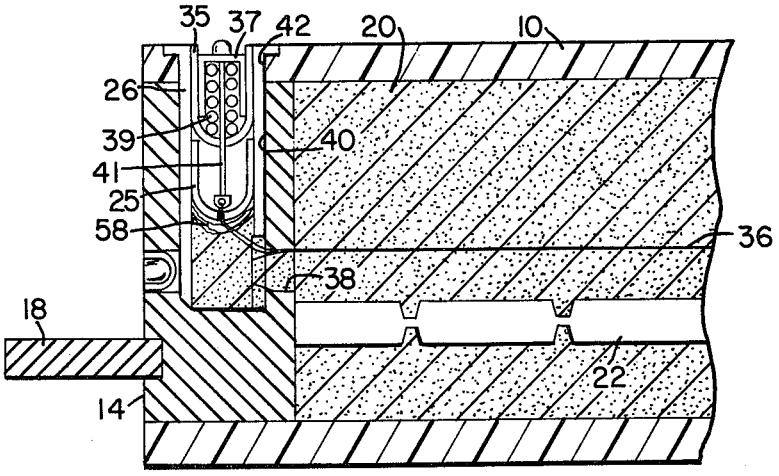
FIG. 6 is a partial view similar to FIG. 1 showing the indicator of FIG. 5 installed in a fuse.

FIGS. 5 and 6 illustrate an embodiment of the invention wherein an indicator 24/mounting sleeve 26 assembly is inserted directly through a side opening 42 in a fuse casing 10 and into a passageway 40 in an end terminal 14. The assembly and function of this embodiment are substantially the same as described hereinabove with respect to the first embodiment. In FIGS. 5 and 6 the same reference characters as in FIGS. 1–4 have been applied to indicate like parts. Thus no detailed description is required.

This invention may be practiced or embodied in still other ways without departing from the spirit or essential charcter thereof. The preferred embodiments described herein are therefore illustrative and not restrictive, the scope of the invention being indicated by the appended claims and all variations which come within the meaning of the claims are intended to be embraced therein.

What is claimed is:

1. An electric fuse having a blown fuse indicator comprising:

a casing of insulating material, said casing being open at opposite longitudinal ends thereof;

first and second end terminals arranged adjacent said ends of said casing and closing said ends;

a fusible element contained within said casing and conductively interconnecting said end terminals;

said first end terminals having a first opening therein in a surface thereof facing the interior of said fuse casing and having a second opening therein in a peripheral surface thereof which lies in a plane which is substantially parallel to the longitudinal axis of said casing, said first terminal further having an internal passageway therein communicating said first and second openings;

said fuse casing having an opening therein in axial alignment with said second opening in said terminal;

a spring loaded blown fuse indicator means for extending through said opening in said fuse casing and through said second opening in said terminal wherein it fixedly and conductively engages at least a portion of said passageway;

an indicator restraining wire having one end thereof attached to and extending from said spring loaded indicator through said passageway to the interior of said fuse, and from there extending along the length of said fuse to said second end terminal, said wire being tautly stretched along said path; and means for conductively attaching the other end of said wire to said second terminal.

2. The apparatus of claim 1 further comprising an indicator means mounting sleeve having an interior bore, wherein said indicator bore of said sleeve and said sleeve is in turn received within said casing opening and said second opening in said terminal and fixedly and conductively engages at least a portion of said passageway.

3. The apparatus of claim 2 wherein the outer surface of said mounting sleeve contains a plurality of longitudinally extending grooves therein to facilitate positive retention within said portion of said passageway.

4. The apparatus of claim 3 wherein said mounting sleeve includes a head portion which is larger than said opening in said casing to thereby engage the outer wall of said casing when said sleeve is inserted to its operative position.

5. The apparatus of claim 2 further comprising a block of insulating material having an opening therethrough adapted to cooperate with said mounting sleeve in such a manner that said block is fixedly supported in a position exterior of said fuse casing with said blown fuse indicator visually accessible.

6. The apparatus of claim 5 wherein the outer surface of said mounting sleeve contains a plurality of longitudinally extending grooves therein to facilitate positive retention of said sleeve within said portion of said passageway.

7. The apparatus of claim 6 wherein said mounting sleeve includes a head portion which is larger than said opening in said casing to thereby engage the outer wall of said casing when said sleeve is inserted to its operative position.

8. The apparatus of claim 5 further comprising a secon indicating means mounted on said insulating block for generating an indicating signal responsive to actuation of said spring loaded indicator.

9. The apparatus of claim 1 wherein said first end terminal comprises a solid metal plug having an outer peripheral surface adapted to be received in close mating cooperation with the inner surface of the end of said casing which it closes and wherein said indicator means comprises an indicator mounting sleeve having an interior bore and an indicator pin assembly which is fixedly and conductively mounted within said interior bore of said sleeve and said sleeve is in turn received within said casing opening and said second opening in said first end terminal and fixedly and conductively engages at least a portion of said passageway.

10. The apparatus of claim 9 wherein said mounting sleeve includes a head portion which is larger than said opening in said casing to thereby engage the outer wall of said casing when said sleeve is inserted to its operative position, the outer surface of said mounting sleeve containing a plurality of longitudinally extending grooves therein to facilitate positive retention of said sleeve in its said operative position.

11. An electric fuse having a blown fuse indicator comprising:

a casing of insulating material, said casing being open at opposite longitudinal ends thereof;

first and second end terminals arranged adjacent said ends of said casing and closing said ends;

a fusible element contained within said casing and conductively interconnecting said end terminals;

said first end terminal having a first passageway therein extending from a surface of said terminal facing the interior of said fuse casing and extending at least partially into said terminal in a direction substantially parallel to the longitudinal axis of said casing, said first terminal having a second passageway therein extending from a peripheral surface of said terminal in a direction substantially perpendicular to and intersecting with, said first passageway;

said fuse casing having an opening therein in axial alignment with said second passageway;

a spring loaded blown fuse indicator means extending through said opening in said fuse casing and into said second passageway wherein it fixedly and conductively engages at least a portion of said second passageway;

an indicator restraining wire having one end thereof attached to and extending from said spring loaded indicator along a path comprising:

at least a portion of said second passageway;

a turn into and through said first passageway and from there along the length of said fuse, said wire being tautly stretched along said path; and means for conductively attaching the other end of said wire to said second terminal.

12. The apparatus of claim 11 wherein said first end terminal comprises a solid metal plug having an outer peripheral surface adapted to be received in close mating contact with the inner surface of one of said ends of said casing and wherein said indicator means comprises a mounting sleeve having an interior bore, said spring loaded indicator pin assembly being received in press fit relation within said interior bore of said mounting sleeve, said mounting sleeve being adapted to be inserted through said opening in said tubing and to be fixedly received in said second passageway, said mounting sleeve having a head portion which is larger than said opening in said casing to thereby engage the outer wall of said casing when said sleeve is inserted to its operative position.

13. The apparatus of claim 12 wherein the outer surface of said mounting sleeve contains a plurality of longitudinally extending grooves therein to facilitate positive retention in its said operative position.

14. An electric fuse having a blown fuse indicator comprising:

a casing of insulating material, said casing being open at opposite longitudinal ends thereof;

first and second end terminals arranged adjacent said ends of said casing and closing said ends;

said first end terminal having a portion thereof extending coextensively with a longitudinal portion of said casing, said first terminal having a through opening therein extending in a direction substantially perpendicular to the longitudinal axis of said casing;

said fuse casing having a through opening therein in substantially axial alignment with said opening in said first end terminal said casing opening and said end terminal opening together defining a passageway extending from the exterior of said fuse to the interior thereof in a direction perpendicular to the longitudinal axis of the fuse casing;

a spring loaded blown fuse indicator means extending through said passageway and adapted to fixedly and conductively engage at least a portion of said opening in said first terminal when in its operative position therein;

an indicator restraining wire having one end thereof attached to and extending from said spring loaded indicator along a path comprising:

a portion thereof extending in said direction perpendicular to the longitudinal axis of the fuse casing;

a turn portion leading into the interior of said fuse and from there along the length of said fuse to the other end terminal thereof, said wire being tautly stretched along said path; and means for conductively attaching the other end of said wire to said second terminal.

15. The apparatus of claim 14 further comprising an indicator means mounting sleeve having an interior bore, wherein said indicator means is mounted within said interior bore of said sleeve and said sleeve is in turn received within said passageway perpendicular to said longitudinal axis of said fuse and fixedly and conductively engages at least a portion of said opening in said first end terminal.

16. The apparatus of claim 15 wherein the outer surface of said mounting sleeve contains a plurality of longitudinally extending grooves therein to facilitate positive retention in its said operative position.

17. The apparatus of claim 14 wherein said first end terminal comprises a solid metal plug having an outer peripheral surface adapted to be received in close mating contact with the inner surface of the end of said fuse casing which it closes, said terminal plug having a second opening therein extending from a surface thereof facing the interior of said fuse casing and extending at least partially into said terminal plug in a direction substantially parallel to the longitudinal axis of said casing and intersecting with said through opening of said first terminal.

* * * * *